US009541362B2

(12) United States Patent
Kraft et al.

(10) Patent No.: US 9,541,362 B2
(45) Date of Patent: Jan. 10, 2017

(54) CUSTOMIZABLE PROJECTILE DESIGNED TO TUMBLE

(71) Applicant: Ward Kraft, Inc., Fort Scott, KS (US)

(72) Inventors: Ryan Kraft, Fort Scott, KS (US); Gary Buntain, Fort Scott, KS (US)

(73) Assignee: Ward Kraft, Inc., Fort Scott, KS (US)

( * ) Notice: Subject to any disclaimer, the term of this patent is extended or adjusted under 35 U.S.C. 154(b) by 104 days.

(21) Appl. No.: 14/604,002

(22) Filed: Jan. 23, 2015

(65) Prior Publication Data

US 2015/0362302 A1 Dec. 17, 2015

Related U.S. Application Data

(60) Provisional application No. 61/931,362, filed on Jan. 24, 2014.

(51) Int. Cl.

| | |
|---|---|
| ***F42B 10/00*** | (2006.01) |
| ***F42B 12/02*** | (2006.01) |
| ***F42B 30/02*** | (2006.01) |

(52) U.S. Cl.

CPC ..... *F42B 12/02* (2013.01); *F42B 30/02* (2013.01)

(58) Field of Classification Search

CPC ..... F42B 30/02

USPC ..... 102/501, 517, 514, 519

See application file for complete search history.

(56) References Cited

U.S. PATENT DOCUMENTS

| | | | | |
|---|---|---|---|---|
| 3,949,677 | A * | 4/1976 | Voss | F42B 30/02 102/501 |
| 4,836,108 | A * | 6/1989 | Kegel | F42B 12/74 102/306 |
| 5,652,407 | A | 7/1997 | Carbone | |
| 5,767,438 | A * | 6/1998 | Lang | F42B 5/025 102/439 |
| 5,798,478 | A * | 8/1998 | Beal | F42B 10/44 102/490 |
| 6,305,293 | B1 * | 10/2001 | Fry | F42B 12/78 102/516 |
| 7,300,357 | B2 | 11/2007 | Breaker et al. | |
| 7,455,015 | B2 | 11/2008 | Krstic | |
| 7,741,588 | B2 | 6/2010 | Gundel et al. | |
| 7,748,325 | B2 | 7/2010 | Marx | |
| 7,874,253 | B2 | 1/2011 | Marx | |
| 7,980,180 | B2 | 7/2011 | MacDougall | |
| 8,176,850 | B2 | 5/2012 | Thompson et al. | |
| 8,783,187 | B2 | 7/2014 | Amick | |
| 8,893,621 | B1 | 11/2014 | Escobar | |

* cited by examiner

*Primary Examiner* — J. Woodrow Eldred
(74) *Attorney, Agent, or Firm* — Lathrop & Gage L.L.P.

(57) ABSTRACT

A projectile or bullet for a firearm. The projectile tumbles upon impact with a target. The projectile may be tailored to control the location of the tumbling.

6 Claims, 3 Drawing Sheets

CUSTOMIZABLE PROJECTILE DESIGNED TO TUMBLE

RELATED APPLICATIONS

This application claim priority to U.S. Provisional Application Ser. No. 61/931,362, filed Jan. 24, 2014, the disclosure of which is incorporated herein by reference.

FIELD OF INVENTION

The field of the invention is projectiles for use in cartridges fired from handguns and other firearms.

BACKGROUND OF INVENTION

Projectiles, or bullets, are made in a variety of shapes and sizes depending upon their intended use. The shape and size of a projectile affects the kinetic energy that is transferred to a target upon impact. The kinetic energy of a discharged projectile will be a function of its mass and its velocity via the well-known formula Kinetic Entergy (KE)=½ (mass)(velocity)(velocity). Often, as is the case in hunting, it is desirable to maximize the kinetic energy transferred by the projectile, thus increasing its lethality.

Most projectiles that are designed to maximize lethality suffer from various shortcomings. Expanding projectiles and fragmenting projectiles, for example, succeed in causing an increased amount of damage to a target, compared to the average projectile. However, expanding and fragmenting projectiles frequently transfer an inadequate amount of energy to the target. Further, expanding and fragmenting projectiles are generally difficult to control and, thus, produce inconsistent results.

Projectiles that are designed to tumble typically transfer a higher amount of kinetic energy than those previously discussed. A problem observed with prior art designs for tumbling projectiles is the inability to control how and when the projectile tumbles.

BRIEF SUMMARY OF INVENTION

The present invention comprises designs for a projectile, or bullet, which tumbles upon impact with a target. The design of the projectile may be tailored to the specification of the shooter or designer for a specific target so as to create an optimal energy release at an optimal depth in the target, thus increasing the efficiency. The projectile is generally made of copper or similar material. However, any type of metal, composite, or combination thereof may be used.

DETAILED DESCRIPTION OF THE INVENTION

Figure 1:
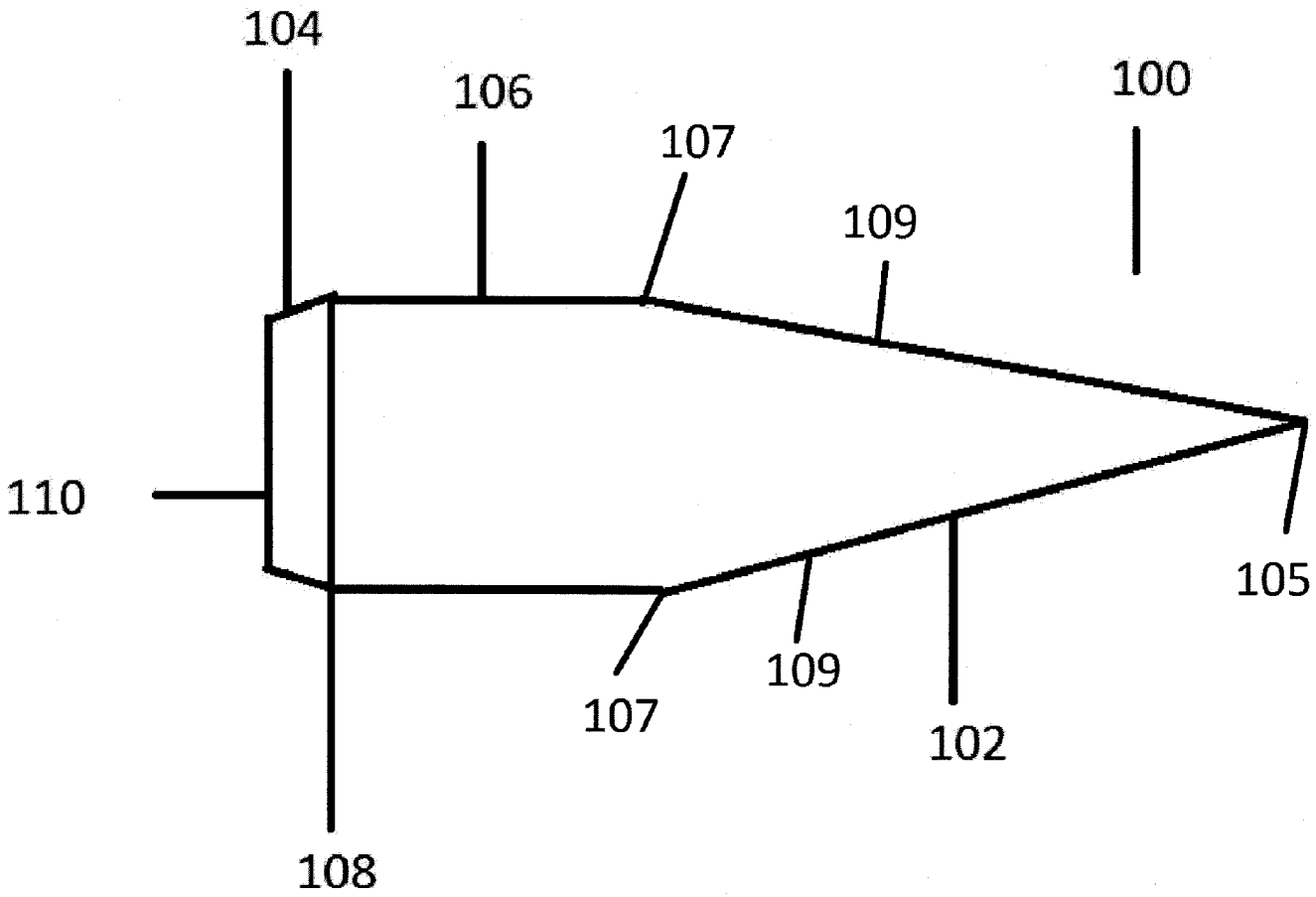
FIG. 1 is a schematic cross-sectional view of one embodiment of a projectile used in a firearm, according to the invention.

FIG. 1 shows a schematic cross-sectional view of one embodiment 100 of projectile. The projectile 100 is generally cylindrical shaped with a first portion 102 extending from a second or middle portion 106 of the projectile 100 to form a point 105 at a leading end of the projectile 100. The first portion 102 has a trailing end 107 and a first portion side 109. The first portion trailing end 107 may just designate the location along the length of the projectile 100 where the diameter of the projectile 100 begins to decrease, thus tapering the projectile 100 in the direction of its leading end. The second portion 106 generally has a larger diameter than the first portion 102, although the second portion 106 may vary in diameter and length. The third portion 104, which makes up the base of the projectile 100, extends from the second portion 106, opposite the first portion 102. The diameter of the third portion 104 generally tapers as it extends away from the second portion 106. The first side 108 of the third portion 104 is generally the same diameter as the second portion 106. The diameter of the second side or trailing end 110 of the third portion 104 is generally smaller than that of the first side 108.

The tumbling of the projectile 100 may be controlled by changing the length of the first portion side 109 from the trailing end 107 to the point 105. Increasing such length causes the projectile 100 to begin to tumble very close to or at the target. Decreasing such length causes the projectile 100 to begin to tumble farther from the point of impact. The tumbling of the projectile 100 may also be controlled by flattening the point 105 so that there is a flat surface (not shown) at the leading end or point 105 of the projectile 100. Increasing the diameter of such flat surface causes the projectile to begin to tumble farther from the target, whereas decreasing the diameter of such flat surface causes the projectile to begin to tumble close to or at the target.

Figure 4:
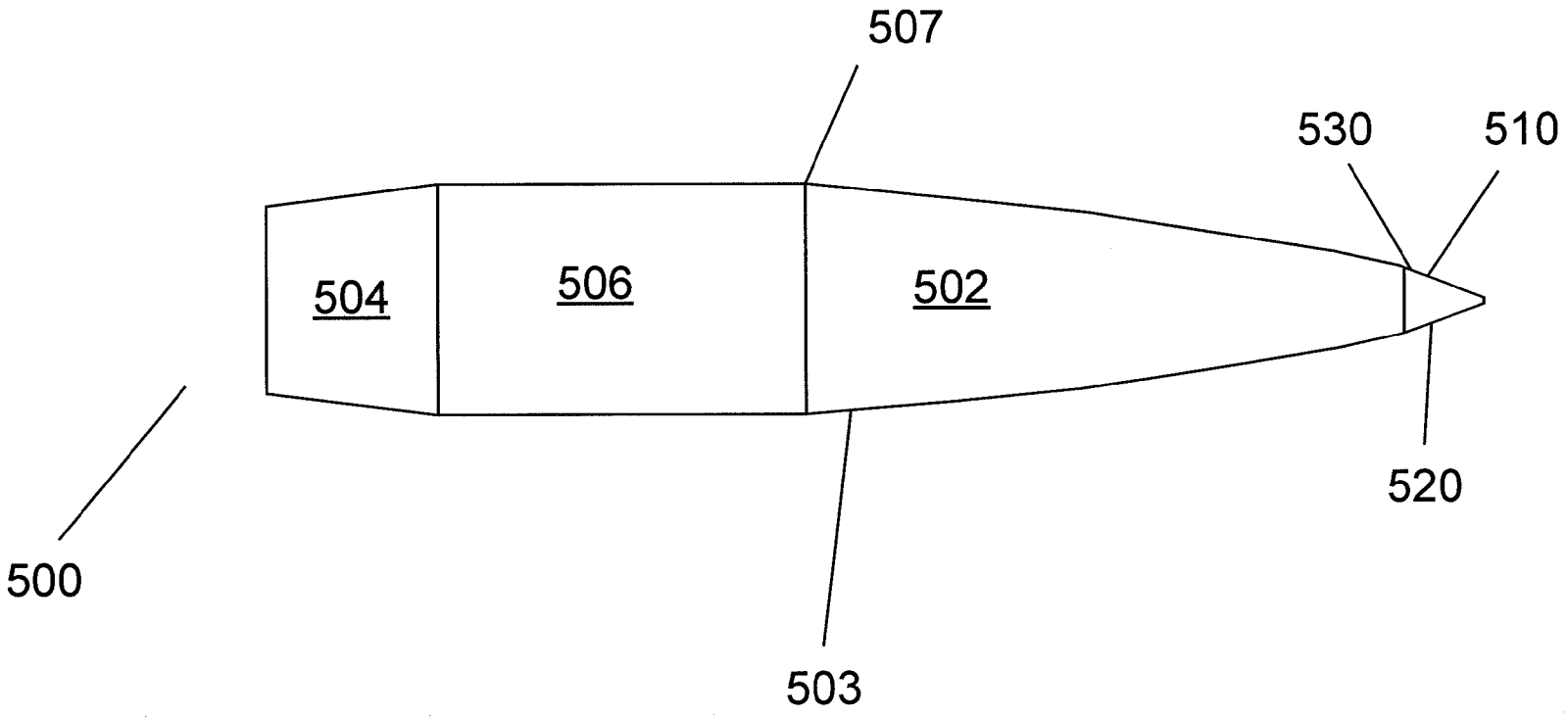
FIG. 4 is a schematic of a cross-sectional view of a projectile according to an embodiment of the present invention.

FIG. 4 shows a second embodiment 500 of a projectile according to the invention.

The projectile 500 has a first portion 502, a first portion side 503, a base 504, a mid-portion 506, a first portion trailing end 507, a pointed tip 510 at a leading end of the projectile 500, a tip side 520, and a tip trailing end 530. The first portion trailing end 507 and the tip trailing end 530 may not be two specific surfaces or disconnected from the part from which they extend. The first portion trailing end 507 and the tip trailing end 530 may just designate the location along the length of the projectile 500 where the diameter of the projectile 500 begins to decrease, thus tapering the projectile 500 in the direction of its leading end. It will be noted that the first portion side 503 forms an acute angle with the first portion trailing end 507, and that the tip side 520 forms a second more acute angle with the tip trailing end 530. The addition of the tip 510 and its second, more acute (sharper) angle with respect to the tip trailing end 530 (and also more acute than the angle between the first portion side 503 and the first portion trailing end 507) causes the projectile 500 to tumble after it impacts a target.

When a projectile impacts a target it releases energy which can be observed as a cavitation in ballistic gel. The cavitation in ballistic gel represents damage that would be caused to the tissue if the projectile 100 or 500 impacted a living target. As the projectile 100 or 500 begins to tumble, an increased amount of energy is released. The design of the projectile 500 may be tailored to the specification of the shooter or designer. The specifications that may be changed to affect the performance of the projectile (i.e. larger cavitation) include a sharper or more acute angle between the tip side 520 and the trailing end 530 of the tip 510, the radius of the first portion 502, the diameter of the point of the nose, the width or diameter of the mid-portion 506, the speed of the projectile 500 when fired from the firearm, and the width or diameter of the base 504. It was found that, if the more acute (sharper) angle between the tip side 520 and the tip trailing end 530 is placed at the forward end of the projectile, as shown in projectile 500, the projectile will tumble early and continue to tumble through the target. If the length of the first portion side 503 is increased the projectile will tumble, and the tumbling of the projectile 500 will increased in frequency as the length of the first portion 503 is increased. However, as the length of the first portion side 503 is decreased, the projectile is less likely to tumble, and further shortening the first portion side 503 can prevent the projectile from tumbling at all. It should also be noted that by changing certain aspects of the design, such as length of the tip, for example, performance may be affected in ways other than just tumbling. For example, the yaw or roll of the bullet may be affected by such changes.

Figure 2:
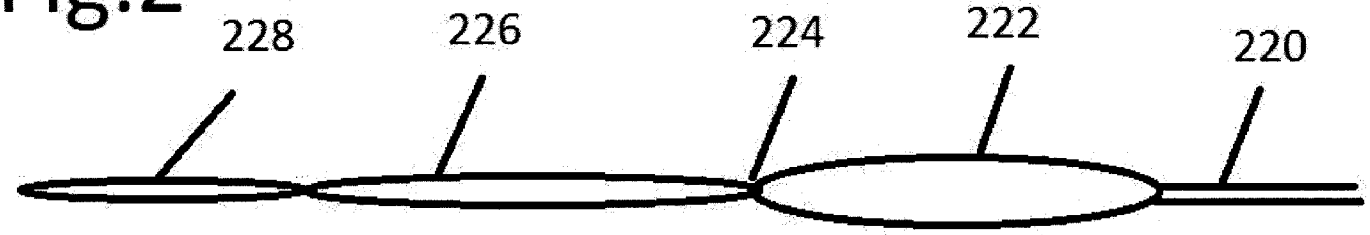
FIG. 2 is a schematic showing the motion of a projectile, according to a prior art design, fired into ballistic gel.

FIG. 2 shows the motion of a projectile, according to prior art designs, fired into ballistic gel. As the projectile enters the ballistic gel it creates a steady channel 220 prior to tumbling. As the projectile tumbles it creates the first cavitation 222. It immediately tumbles a second time, creating a second cavitation 226. After the second cavitation 226, the projectile creates another steady channel 228 until it stops.

Figure 3:
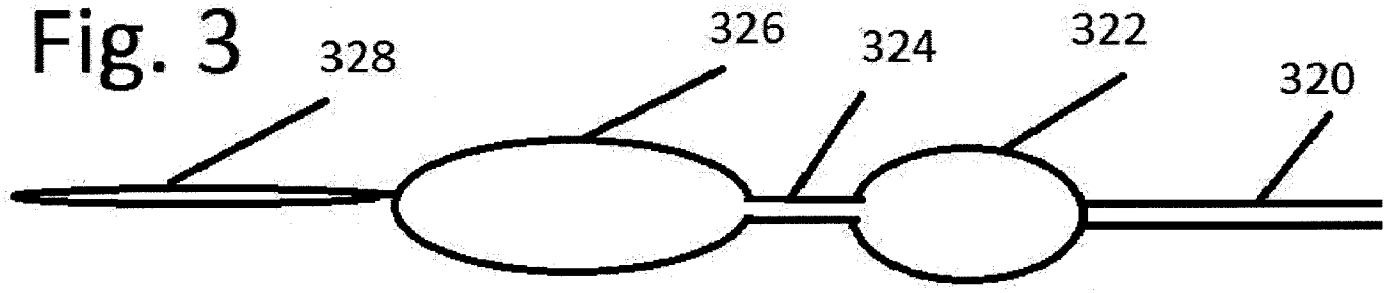
FIG. 3 is a schematic showing the motion of a projectile, according to a second embodiment of the present invention, fired into ballistic gel.

FIG. 3 shows the motion of a projectile according to the embodiment 500 of FIG. 4 fired into ballistic gel. As the projectile enters the ballistic gel it creates a steady channel 320 prior to tumbling. As the projectile tumbles it creates the first cavitation 322. It then creates a short steady channel 324 before it tumbles a second time, creating a second cavitation 326. After the second cavitation 326, the projectile creates another steady channel 328 until it stops.

The table below summarizes the measurements of the motion of the projectiles discussed in FIGS. 2 and 3:

| | Length of channel prior to first cavitation | Length of first cavitation | Length between first and second cavitation | Length of second cavitation | Length of channel following second cavitation | Total length of channel |
|---|---|---|---|---|---|---|
| FIG. 2 | 1.5" | 3" | 0 | 2" | 5.5" | 12" |
| FIG. 3 | 3" | 2.5" | 1.25" | 5.25" | 6" | 18" |

The data shown in the table above demonstrates the benefits of the present invention. Compared to the projectile in FIG. 2, the embodiment 500 of the present invention whose cavitation patterns are shown in FIG. 3 transferred an increased amount of energy to the target and did so in a more efficient manner. As shown in FIG. 3, the embodiment 500 of the present invention create, in total, longer channels (18 inches) in the target than the prior art design projectile of FIG. 2 (12 inches). As well, the cavitation in FIG. 3 is larger than that in FIG. 2 which signifies an increased amount of damage caused to the target. Moreover, the embodiment 500 is more lethal and, thus, more humane when used to hunt. Projectiles such as 500 have been found to tumble more dramatically when they impact a viscous object, such as an animal organ, than if they impact something more solid such as wood or metal. This feature is more prominent with embodiments such as 500 than with others known to be available, including those that tumble.

We claim:

1. A projectile that tumbles upon impact with a target comprising:
   (a) a first portion having a first length, a first portion side and a first portion trailing end; the first portion side forming a first acute angle with the first portion trailing end;
   (b) a pointed tip extending forwardly from the first portion, the tip having a tip trailing end and a tip side, the tip side forming a second acute angle with the tip trailing end;
   (c) a second portion extending rearwardly from the first portion; the second portion being cylindrical and having a second length; and
   (d) a frustoconical base portion extending rearwardly from the second portion and having a distal end;

wherein:
   the first acute angle is greater than the second acute angle;
   the first length is greater than the second length; and
   the projectile terminates at a rear side in a solitary vertical plane defined by a vertical wall extending from the distal end.

2. The projectile of claim 1 wherein the projectile is made of at least one of of metal, composite, or combination thereof.

3. A projectile configured to tumble upon impact with a target, comprising:
   (a) a first portion having a first length, a first portion side and a first portion trailing end; the first portion side forming a first acute angle with the first portion trailing end;
   (b) a tip extending forwardly from the first portion, the tip having a tip trailing end and a tip side, the tip side forming a second acute angle with the tip trailing end;
   (c) a second portion extending rearwardly from the first portion; the second portion being cylindrical and having a second length; and
   (d) a frustoconical base portion extending rearwardly from the second portion; the base portion having a third length;

wherein:
   the first acute angle is greater than the second acute angle;
   the first length is greater than the second length; and
   the second length is greater than the third length.

4. The projectile of claim 3, wherein the tip has a flattened front end.

5. The projectile of claim 4, wherein the projectile terminates at a continuous vertical wall at a rear of the base portion.

6. The projectile of claim 4, wherein the projectile is made of composite materials.

* * * * *